US008983352B2

(12) United States Patent
Sasaki

(10) Patent No.: US 8,983,352 B2
(45) Date of Patent: Mar. 17, 2015

(54) FIXING DEVICE AND IMAGE FORMING APPARATUS PROVIDED WITH THE SAME

(71) Applicant: Konica Minolta, Inc., Tokyo (JP)

(72) Inventor: Takuya Sasaki, Toyokawa (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 183 days.

(21) Appl. No.: 13/629,142

(22) Filed: Sep. 27, 2012

(65) Prior Publication Data

US 2013/0084112 A1 Apr. 4, 2013

(30) Foreign Application Priority Data

Sep. 30, 2011 (JP) ..... 2011-217661
Aug. 31, 2012 (JP) ..... 2012-191523

(51) Int. Cl.
*G03G 15/20* (2006.01)

(52) U.S. Cl.
CPC .... *G03G 15/2053* (2013.01); *G03G 2215/0132* (2013.01); *G03G 2215/2035* (2013.01)
USPC ..... 399/329

(58) Field of Classification Search
USPC ..... 399/328, 329, 335, 337
See application file for complete search history.

(56) References Cited

U.S. PATENT DOCUMENTS

2008/0124111 A1* 5/2008 Baba et al. ..... 399/69
2010/0215414 A1 8/2010 Uchiyama et al.

FOREIGN PATENT DOCUMENTS

| | | |
|---|---|---|
| JP | 2010-2509 | 1/2010 |
| JP | 2010-197737 | 9/2010 |
| JP | 2010-230820 | 10/2010 |
| JP | 2010-249917 | 11/2010 |

* cited by examiner

*Primary Examiner* — David Bolduc
*Assistant Examiner* — Barnabas Fekete
(74) *Attorney, Agent, or Firm* — Buchanan Ingersoll & Rooney PC

(57) ABSTRACT

A fixing device that fixes an unfixed image on a sheet by heat and pressure, including an endless belt, a magnetic flux generator provided outside the running path of the belt and generating magnetic flux to cause an induction heating layer in the belt to heat, a heat-control plate provided inside the running path and including a magnetic shunt alloy layer that loses magnetism upon exceeding a predetermined temperature, and a support member supporting the heat-control plate. The heat-control plate includes a first region facing the magnetic flux generator with the belt therebetween and second regions extending continuously in a circumferential direction of the belt from opposite edges of the first region. Inside the running path, the support member is in contact with the heat-control plate at the second regions and not at the first region so as to support the heat-control plate at the second regions.

21 Claims, 11 Drawing Sheets

FIG. 8

| | Time (sec) until reaching 160° C with 1400 W power supply |
|---|---|
| Working example | 19 |
| Comparative example 1 | 23 |
| Comparative example 2 | 28 |

FIXING DEVICE AND IMAGE FORMING APPARATUS PROVIDED WITH THE SAME

This application is based on applications No. 2011-217661 and No. 2012-191523 filed in Japan, the contents of which are hereby incorporated by reference.

BACKGROUND OF THE INVENTION (1) Field of the Invention

The present invention relates to a fixing device based on electromagnetic induction heating and an image forming apparatus provided with the fixing device.

(2) Description of the Related Art

Image forming apparatuses such as printers are provided with a fixing device that fixes an unfixed image, formed on a sheet and constituted by toner and the like, to the sheet by heating and applying pressure to the unfixed image when passing the sheet through a fixing nip. The fixing device may, for example, be based on electromagnetic induction heating. In such a fixing device, an excitation coil is provided on the outside of the running path of a fixing belt that has an induction heating layer. Magnetic flux that is generated by allowing alternating current to flow through the excitation coil is channeled to the induction heating layer, thereby heating the fixing belt.

In a fixing device based on electromagnetic induction heating, the heat capacity of the fixing belt can be set to a small value, thus allowing for a reduction in the time required for the temperature of the fixing belt to rise to a predetermined fixing temperature (i.e. the warm-up period).

As the heat capacity of the fixing belt decreases, however, the rate of temperature increase per unit of input power increases. Therefore, continuous use of small, narrow sheets leads to the problem that, compared to a region of the fixing belt through which the sheet passes (corresponding to the width of the sheet, and hereinafter referred to as the "sheet conveyance region"), the temperature rises in a region through which the sheet does not pass (hereinafter referred to as the "non-sheet conveyance region") on either side of the sheet conveyance region in the direction of width of the belt. This leads to thermal destruction and deterioration of surrounding components.

One method for controlling a rise in temperature of the non-sheet conveyance region is to provide a self-adjusting temperature control function that reduces the amount of heat in the non-sheet conveyance region. With this method, a plate member (hereinafter referred to as a "heat-control plate") is provided on the inside of the running path of the fixing belt, so that the fixing belt is between the excitation coil and the heat-control plate. The heat control plate includes a magnetic shunt alloy layer having a Curie point of a predetermined temperature higher than the fixing temperature. When the temperature of the non-sheet conveyance region rises to the Curie point, which is higher than the fixing temperature, the portion of the magnetic shunt alloy layer in the heat-control plate corresponding to the non-sheet conveyance region loses its magnetism.

The heat-control plate is in sliding contact with the inner circumferential surface of the fixing belt during rotation of the fixing belt and receives the load in the circumferential direction of the frictional force generated between the heat-control plate and the fixing belt. So that the heat-control plate does not change shape due to this load, the heat-control plate is strengthened by increasing the thickness of the heat-control plate, and by extending the edges of the heat-control plate in the direction of width of the belt beyond the edges of the fixing belt and securing the heat-control plate to the housing of the fixing device.

Increasing the thickness of the heat-control plate, however, causes a corresponding increase in the heat capacity of the heat-control plate, thus lowering the rate of temperature increase of the heat-control plate. This facilitates thermal transfer from the fixing belt to the heat-control plate, which in turn allows heat to escape to the device housing, thereby reducing the capability of the belt to rise in temperature.

SUMMARY OF THE INVENTION

An aspect of the present invention is a fixing device based on electromagnetic induction heating that, when a sheet with an unfixed image formed thereon passes through a fixing nip, applies heat and pressure to the sheet in order to fix the unfixed image thereto, the fixing device comprising: an endless belt driven to rotate and including an induction heating layer; a pressing member pressing against a surface of the belt to form the fixing nip between the pressing member and the surface of the belt; a magnetic flux generator provided outside of a running path of the belt and generating magnetic flux to cause the induction heating layer to heat; a heat-control plate provided inside of the running path of the belt and including a magnetic shunt alloy layer that loses magnetism upon exceeding a predetermined temperature higher than a fixing temperature; and a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions.

Another aspect of the present invention is an image forming apparatus comprising: an unfixed image forming unit forming an unfixed image on a sheet; and a fixing device fixing the unfixed image to the sheet by applying heat and pressure to the sheet when the sheet passes through a fixing nip, the fixing device comprising: an endless belt driven to rotate and including an induction heating layer; a pressing member pressing against a surface of the belt to form the fixing nip between the pressing member and the surface of the belt; a magnetic flux generator provided outside of a running path of the belt and generating magnetic flux to cause the induction heating layer to heat; a heat-control plate provided inside of the running path of the belt and including a magnetic shunt alloy layer that loses magnetism upon exceeding a predetermined temperature higher than a fixing temperature; and a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings:

FIG. 8 illustrates the results of an experiment on temperature rise characteristics of the fixing belt when adopting the structure of the heat-control plate in a working example and the structure of the heat-control plate in two comparative examples;

DESCRIPTION OF THE PREFERRED EMBODIMENTS

The following describes an embodiment of a fixing device and an image forming apparatus according to the present invention, using a tandem-type color printer (hereinafter simply referred to as a "printer") as an example.

1. Overall Structure of Printer

Figure 1:
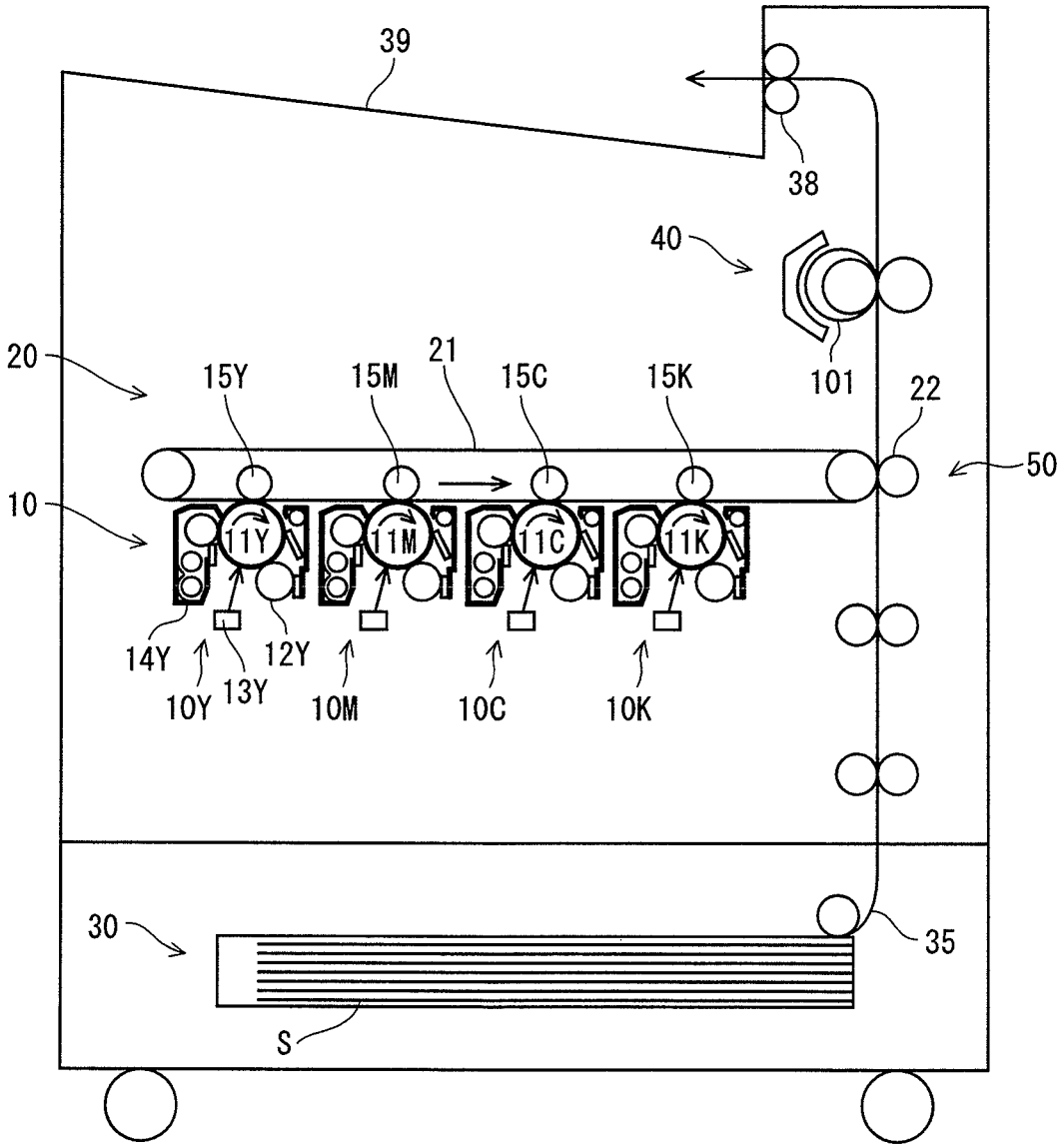
FIG. 1 illustrates the overall structure of the printer.

FIG. 1 illustrates the overall structure of a printer 1.

As illustrated in FIG. 1, the printer 1 forms images using well-known electrophotography. The printer 1 is provided with an image forming unit 10, a belt conveyance unit 20, a feed unit 30, and a fixing unit 40. The printer 1 is connected to a network (such as a LAN). Upon receiving an instruction for a print job from an external terminal device (not shown in the figures), the printer 1 performs color image formation based on the instruction using the colors yellow (Y), magenta (M), cyan (C), and black (K).

The image forming unit 10 is provided with imaging units 10Y through 10K, corresponding to the colors Y through K. The imaging unit 10Y is provided with a photoconductor drum 11Y and, disposed around the photoconductor drum 11Y, a charger 12Y, an exposure unit 13Y, a developer 14Y, a first transfer roller 15Y, a cleaner for cleaning the photoconductor drum 11Y, and the like. A Y-color toner image is formed on the photoconductor drum 11Y after completing well-known charging, exposure, and developing processes. The other imaging units 10M through 10K have a similar structure, and toner images of corresponding colors are formed on the photoconductor drums 11M through 11K.

The belt conveyance unit 20 is provided with an intermediate transfer belt 21 that rotates in the direction indicated by the arrow.

The feed unit 30 feeds recording sheets S from a paper cassette to a conveyance path 35 one sheet at a time.

At transfer positions on the photoconductor drums 11Y through 11K, the toner images formed on the photoconductor drums 11Y through 11K undergo primary transfer to the rotating intermediate transfer belt 21 due to the effect of an electrostatic force from the electrical field produced between the first transfer rollers 15Y through 15K and the respective photoconductor drums 11Y through 11K. The timing of this image creation for each color is shifted so that the toner images are overlapped on the same position along the intermediate transfer belt 21.

In coordination with the timing of image creation, a sheet S is fed from the feed unit 30 and is transported while sandwiched between the intermediate transfer belt 21 and a secondary transfer roller 22 that presses against the intermediate transfer belt 21. The toner images of various colors simultaneously undergo secondary transfer to the sheet S due to the effect of an electrostatic force from the electrical field produced by secondary transfer voltage applied to the secondary transfer roller 22. The resulting toner image on the sheet S is an unfixed image. The image forming unit 10, the belt conveyance unit 20, and the secondary transfer roller 22 constitute an unfixed image forming unit 50 that faints the unfixed image on the sheet S. After secondary transfer, the sheet S is transported to the fixing unit 40.

The fixing unit 40 is based on electromagnetic induction heating and is provided with a fixing belt 101. The fixing unit 40 uses heat and pressure to fix the toner images of various colors formed on the sheet S by secondary transfer of the unfixed image. After fixing, the sheet S is ejected out of the device by a pair of discharge rollers 38 and is stored in a storage tray 39.

2. Structure of Fixing Unit 40

Figure 2:
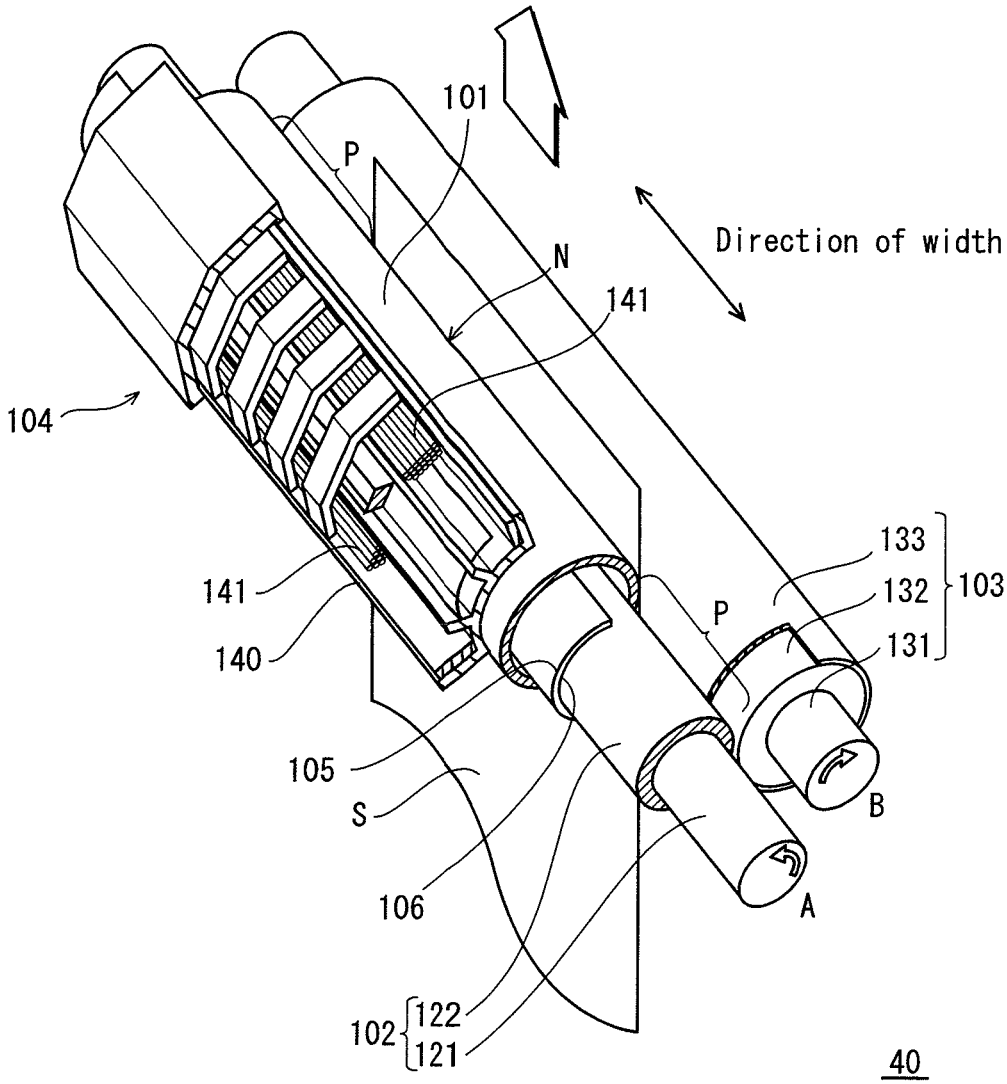
FIG. 2 is a perspective view illustrating the structure of a fixing unit in the printer.
Figure 3:
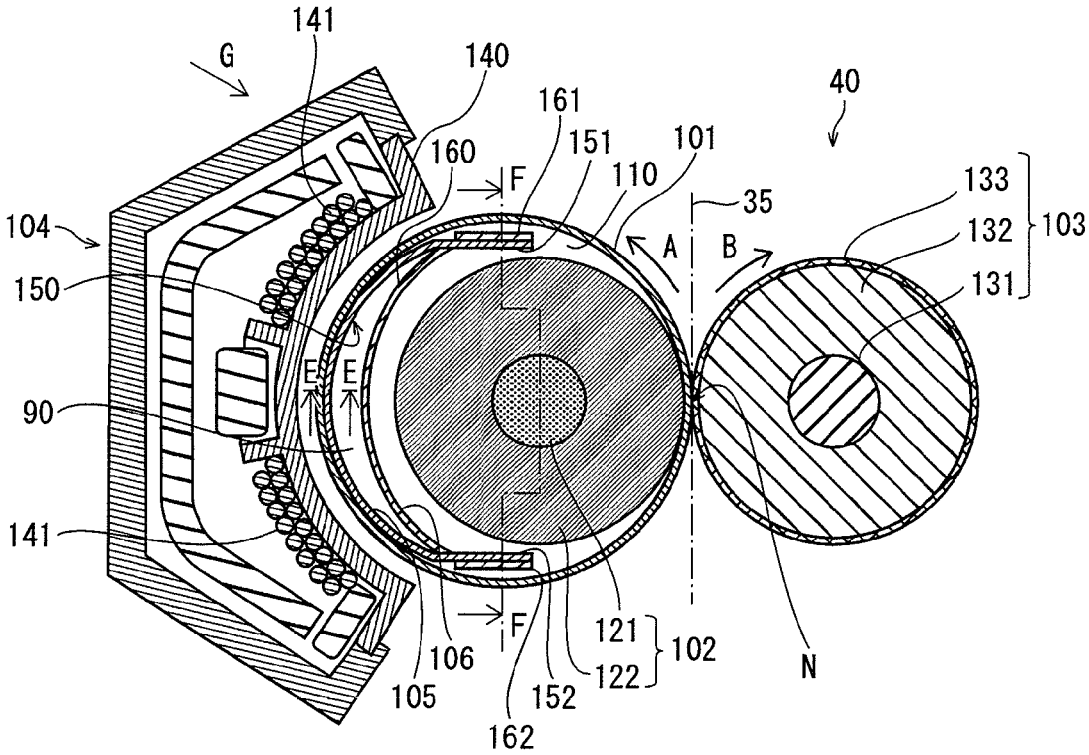
FIG. 3 is a lateral cross-section diagram illustrating the structure of the fixing unit.

FIG. 2 is a perspective view of the structure of the fixing unit 40, and FIG. 3 is a cross-section diagram of the structure of the fixing unit 40. Note that in FIG. 2, for the sake of convenience, the fixing unit 40 is depicted with a portion thereof cut away.

As shown in FIGS. 2 and 3, the fixing unit 40 is provided with an endless fixing belt 101, a fixing roller 102, a pressing roller 103, a magnetic flux generator 104, a heat-control plate 105, a support member 106, and the like.

Structure of Fixing Belt 101

The fixing belt 101 is a shape-preserving tube that elastically deforms upon application of a certain force in the radial direction and that returns from the deformed state, through its own restorative force, to a tubular shape when application of the external force ceases.

Figure 4:
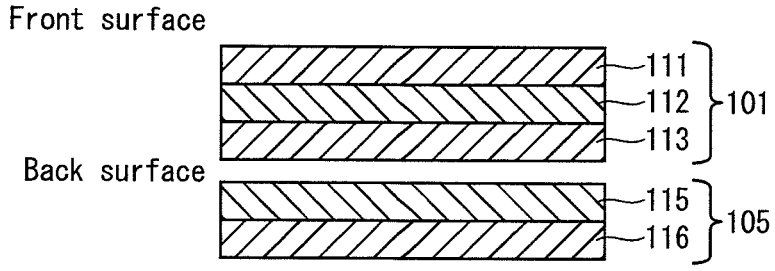
FIG. 4 illustrates a cross-section of a fixing belt and a heat-control plate.

FIG. 4 shows a cross-section of the fixing belt 101 along a line from E to E in FIG. 3. A releasing layer 111, an elastic layer 112, and an induction heating layer 113 are layered in this order from the surface of the fixing belt 101. The releasing layer 111 is, for example, a 20 μm thick layer of PFA (tetrafluoroethylene perfluoroalkoxy vinyl ether copolymer). The elastic layer 112 is, for example, a 200 μm thick layer of silicone rubber, fluorine-containing rubber, or the like.

The induction heating layer 113 is, for example, a 40 μm thick layer of nickel or the like and heats up due to magnetic flux produced by the magnetic flux generator 104. Note that the induction heating layer 113 is not limited to nickel. Another magnetic or non-magnetic material may be used, as long as the material is suitable for use with electromagnetic induction heating.

Returning to FIG. 2, the length of the fixing belt 101 in the direction of width (i.e. the axial direction of the fixing roller 102, hereinafter referred to as the "direction of width of the belt") is greater than the width of the maximum size sheet. FIG. 2 shows a small sheet of paper, which is smaller than the maximum size, passing through a fixing nip N.

Structure of Fixing Roller 102

The fixing roller 102 is an elongated metal core 121 surrounded by an elastic layer 122 and is provided on the inside of the running path of the fixing belt 101 (the path along which the fixing belt 101 rotates, hereinafter referred to as the "belt running path").

The metal core 121, which acts as an axle, is for example formed from stainless steel, iron, aluminum, or the like.

The elastic layer 122 is provided to prevent heat of the fixing belt 101 from escaping to the metal core 121. The elastic layer 122 is made from a heat resistant material with low thermal conductivity, such as a rubber or resin sponge.

When using a silicone sponge, the thickness may be in a range of 1 mm to 10 mm, or more preferably in a range of 2 mm to 7 mm. The hardness of the elastic layer 122 may, for example, be in a range of 20 degrees to 60 degrees in terms of Asker C hardness, or more preferably in a range of 30 degrees to 50 degrees. Note that the overall hardness of the fixing roller 102 is preferably in a range of 30 degrees to 90 degrees in terms of Asker C hardness.

Both ends of the metal core 121 of the fixing roller 102 in the shaft direction are rotatably supported by a device housing 191 (FIG. 7) of the fixing unit 40 via bearings 125 (FIG. 7) that act as a bearing member.

The outer diameter of the fixing roller 102 is smaller than the inner diameter of the fixing belt 101. Since the fixing roller 102 and the fixing belt 101 are in contact at the fixing nip N, a gap 110 exists between the fixing roller 102 and the fixing belt 101 at all locations other than the fixing nip N.

By providing this gap 110, the only region where the fixing belt 101 and the fixing roller 102 are in contact is the fixing nip N. Therefore, this structure reduces heat transfer loss that would occur in a structure without a gap, whereby a portion of the heat generated by the occurring when a portion of the heat emitted by the heating layer of the fixing belt 101 escapes through the metal core 121 of the fixing roller 102 to the device housing 191 that rotatably supports the metal core 121 at either edge.

Structure of Pressing Roller 103

The pressing roller 103 is an elongated metal core 131 surrounded by an elastic layer 132, which is further surrounded by a releasing layer 133. The pressing roller 103 is provided on the outside of the belt running path and presses against the fixing roller 102 with the fixing belt 101 sandwiched therebetween, thereby guaranteeing formation of the fixing nip N between the pressing roller 103 and the surface of the fixing belt 101.

The metal core 131 is, for example, formed from stainless steel. The elastic layer 132 is, for example, formed from rubber. The releasing layer 133 is, for example, formed from a PFA tube.

Both ends of the metal core 131 of the pressing roller 103 in the shaft direction are rotatably supported by the device housing 191 (FIG. 7) of the fixing unit 40 via a bearing member (not shown in the figures). Furthermore, the pressing roller 103 is rotated in the direction indicated by the arrow B in FIG. 2 by transmission of a driving force from a driving motor (not shown in the figures). By rotation of the pressing roller 103, the fixing belt 101 is driven to rotate in the direction indicated by the arrow A, and the fixing roller 102 is driven to rotate in the same direction. Note that alternatively, the fixing roller 102 may be the driving roller, with the fixing belt 101 and the pressing roller 103 being driven.

Structure of Magnetic Flux Generator 104

The magnetic flux generator 104 includes a coil bobbin 140, an excitation coil 141, and the like. The magnetic flux generator 104 is disposed on the outside of the running path of the fixing belt 101 at a position near the fixing belt 101 so as to face the fixing belt 101 along the direction of width of the belt.

The coil bobbin 140 is a plate-shaped member that includes an arc-shaped portion that curves along the circumferential direction of the fixing belt 101 (hereinafter referred to as the "circumferential direction of the belt"). Both ends of the coil bobbin 140 in the direction of width of the belt are fixed to the device housing 191.

The position of the coil bobbin 140 is adjusted so that the gap between the coil bobbin 140 and the surface of the fixing belt 101 (the belt to bobbin distance) is a predetermined value within a range of 1 mm to 2 mm. At the opposite side of the coil bobbin 140 from the fixing belt 101, a plurality of cores is provided. The cores are formed from ferrite, which has a high magnetic permeability, or the like.

The excitation coil 141 is elongated in the direction of width of the belt and is formed by a conducting wire wound around the coil bobbin 140, with a cross-section of the excitation coil 141 being arc-shaped. The excitation coil 141 is slightly longer in the direction of length than the fixing belt 101 is in the direction of width of the belt. The excitation coil 141 is connected to an excitation coil drive circuit (not shown in the figures) that includes a well-known high-frequency inverter. Using AC power supplied by the excitation coil drive circuit, the excitation coil 141 generates magnetic flux for causing the induction heating layer 113 of the fixing belt 101 to heat up.

The magnetic flux generated by the excitation coil 141 is guided to the fixing belt 101 by the cores provided in the coil bobbin 140 and passes mainly through the portion of the induction heating layer 113 of the fixing belt 101 facing the magnetic flux generator 104, producing an eddy current in this portion of the induction heating layer 113 and thereby causing the induction heating layer 113 to heat up. The amount of heat is set to be approximately even at any position along the width of a sheet.

The heat from this heated portion transfers to the pressing roller 103 and the like at the position of the fixing nip N due to rotation of the fixing belt 101, thus causing the temperature of the fixing nip N region to rise. While not shown in the figures, a sensor for detecting the temperature of the fixing belt 101 is provided separately. The current temperature of the fixing belt 101 is detected via a detection signal from the sensor. Based on the detected temperature, the supply of power to the excitation coil 141 is controlled so that the temperature of the fixing nip N is maintained at a target fixing temperature, such as 180° C. When a sheet S is passed through the fixing nip N while the temperature of the fixing nip N is being maintained at the target fixing temperature, the unfixed toner image on the sheet S is thermally fixed to the sheet S by being heated and pressed.

Structure of Heat-Control Plate 105

The heat-control plate 105 is provided within the gap 110 between the fixing belt 101 and the fixing roller 102 at a position so as not to come into contact with the fixing roller 102. The heat-control plate 105 is elongated in the direction of width of the belt, and the length thereof is approximately equal to the width of the fixing belt 101. In addition to functioning as a heat-control member, the heat-control plate 105 also functions to guide the rotating fixing belt 101 in the circumferential direction by being in contact with the inner circumferential surface of the fixing belt 101.

In the present embodiment, the heat-control plate 105 is in contact with the fixing belt 101 even while the fixing belt 101 is not rotating. Alternatively, a structure may be adopted wherein a slight gap exists between the heat-control plate 105 and the fixing belt 101 when the fixing belt 101 is not rotating, with the fixing belt 101 and the heat-control plate 105 coming into contact after the start of rotation due to vibration or the like of the fixing belt 101. The heat-control plate 105 then guides the fixing belt 101 during such contact.

In the cross-section illustrated in FIG. 3, the heat-control plate 105 is formed as an arc that curves in the circumferential direction of the belt at approximately the same curvature as the fixing belt 101. In the circumferential direction of the belt, the heat-control plate 105 includes a central region 150 (first region) and edge regions 151 and 152 (second regions) that extend continuously away from opposite edges of the central region 150 in the circumferential direction of the belt so as to sandwich the central region 150.

The central region 150 of the heat-control plate 105 faces the magnetic flux generator 104 with the fixing belt 101 therebetween and is not in contact with the support member 106.

The edge regions 151 and 152 of the heat-control plate 105 do not face the magnetic flux generator 104. The edge region 151 is in contact with and is supported by an edge region 161 of the support member 106 in the circumferential direction of the belt. The edge region 152 is in contact with and is supported by an edge region 162 of the support member 106 in the circumferential direction of the belt.

As illustrated in FIG. 4, starting at the side of the heat-control plate 105 that is closer to the fixing belt 101, a magnetic shunt alloy layer 115 and a low-resistance conductive layer 116 are layered in this order. The heat-control plate 105 is formed by a method such as plating or vapor deposition, but a method to mechanically bond the two layers may also be used.

The magnetic shunt alloy layer 115 is made from a material, such as permalloy, with a Curie point of a predetermined temperature higher than the fixing temperature. The magnetic shunt alloy layer 115 has a reversible magnetic property: the magnetic shunt alloy layer 115 changes from being magnetic to being non-magnetic (i.e. loses its magnetism) upon exceeding the Curie point and reverts to being magnetic once the temperature falls to the Curie point or below.

The relative permeability of the magnetic shunt alloy layer 115 may, for example, be in a range of 50 to 2000, or preferably in a range of 100 to 1000. The volume resistivity in a temperature range lower than the Curie point may, for example, be in a range of $2\times10^{-8}$ Ωm to $200\times10^{-8}$ Ωm, or preferably in a range of $5\times10^{-8}$ μm to $100\times10^{-8}$ μm. The thickness of the magnetic shunt alloy layer 115 may, for example, be in a range of 100 μm to 1000 μm, or preferably in a range of 200 μm to 600 μm. When the target fixing temperature is approximately 180° C., the Curie point may be in a range of 180° C. to 240° C., or preferably in a range of 190° C. to 220° C. The present embodiment uses a permalloy with a thickness of 400 μm and a Curie point of 220° C.

The Curie point can be adjusted by changing the ratio of the components of the permalloy, as well as by using an alloy that includes chrome, cobalt, molybdenum, or the like. Note that the material for the magnetic shunt alloy layer 115 is not limited to permalloy; another material may be used.

The low-resistance conductive layer 116 is formed from a material with a lower electrical resistance than the magnetic shunt alloy layer 115, such as copper or aluminum.

The magnetic shunt alloy layer 115 and the low-resistance conductive layer 116 can prevent a rise in temperature when consecutively printing a number of small sheets. Specifically, consider portions P in FIG. 2, which are located at opposite edges of the fixing belt 101 in the direction of width of the belt and through which a small sheet S does not pass (i.e. non-sheet conveyance regions). During consecutive printing, when the temperature of the non-sheet conveyance regions P rises above the fixing temperature and reaches the Curie point, due to heat not being absorbed by the sheet S, the portions of the magnetic shunt alloy layer 115 corresponding to the non-sheet conveyance regions P change from being magnetic to being non-magnetic. When the portions of the magnetic shunt alloy layer 115 corresponding to the non-sheet conveyance regions P change to being non-magnetic, it becomes easier in the non-magnetic portions for magnetic flux from the magnetic flux generator 104 to flow from the induction heating layer 113 of the fixing belt 101 through the magnetic shunt alloy layer 115 of the heat-control plate 105 to the low-resistance conductive layer 116.

At portions of the low-resistance conductive layer 116 that correspond to the non-sheet conveyance regions P, magnetic flux is generated in a direction to cancel the magnetic flux that passes through these corresponding portions. This generation of magnetic flux in a canceling direction represses the generation of heat in portions of the induction heating layer 113 in the fixing belt 101 that correspond to the non-sheet conveyance regions P (self-adjusting temperature control function).

Due to this self-adjusting temperature control function, the temperature at the portions corresponding to the non-sheet conveyance regions P does not greatly exceed the Curie point, thus preventing an excessive rise in temperature that would damage the fixing belt 101. Note that while providing the low-resistance conductive layer 116 in combination with the magnetic shunt alloy layer 115 enhances the effectiveness of the self-adjusting temperature control function, a structure without the low-resistance conductive layer 116 may be adopted provided that the self-adjusting temperature control function is sufficiently effective without the low-resistance conductive layer 116.

Structure of Support Member 106

As illustrated in FIG. 3, the support member 106 is provided in the gap 110 between the fixing belt 101 and the fixing roller 102 and has the function of supporting the heat-control plate 105. The support member 106 touches neither the fixing belt 101 nor the fixing roller 102.

The support member 106 is, for example, formed from stainless steel, iron, or aluminum. Any heat resistant material may be used, such as resin.

The support member 106 includes a central region 160 (third region) and edge regions 161 and 162 (fourth regions). A cross-section of the central region 160 is an arc that curves in the circumferential direction of the belt and has a smaller curvature than the heat-control plate 105. The edge regions 161 and 162 extend continuously away from opposite edges of the central region 160 in the circumferential direction of the belt so as to sandwich the central region 160.

The central region 160 of the support member 106 faces the central region 150 of the heat-control plate 105 and is farther from the magnetic flux generator 104 than the central region 150 of the heat-control plate 105 is. The central region 160 is not in contact with the central region 150 of the heat-control plate 105. In other words, a gap 90 exists between the central region 150 of the heat-control plate 105 and the central region 160 of the support member 106.

The edge regions 161 and 162 of the support member 106 support the edge regions 151 and 152 of the heat-control plate 105.

Figure 5:
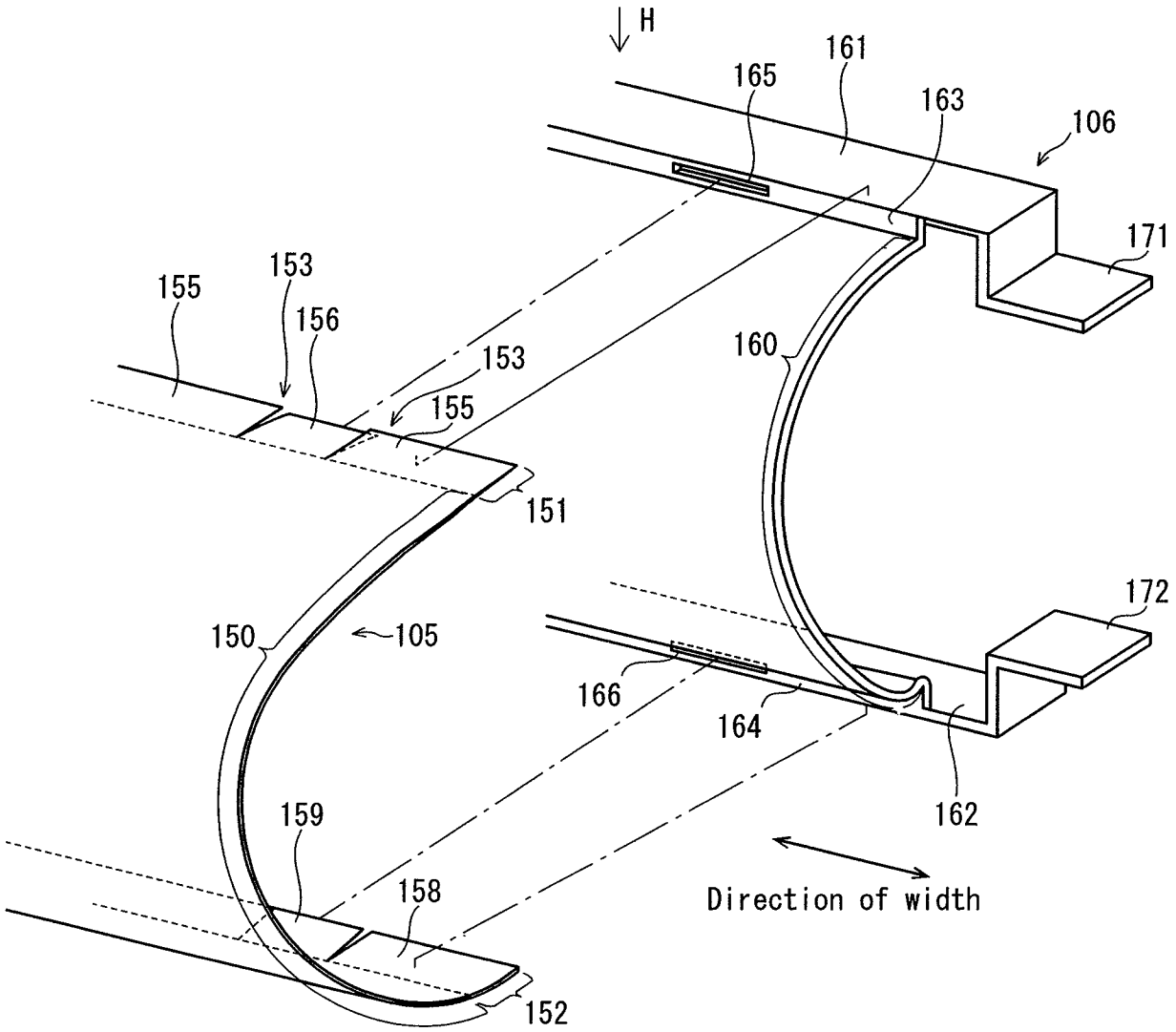
FIG. 5 is a schematic perspective view illustrating the structure of the heat-control plate and a support member.

FIG. 5 is a schematic perspective view illustrating the structure of the heat-control plate 105 and the support member 106 when only the heat-control plate 105 and the support member 106 are viewed in isolation from the direction indicated by the arrow G in FIG. 3. Note that FIG. 5 only illustrates one side in the direction of width of the belt. While the other side is omitted from the figure, it has basically the same structure.

As illustrated in FIG. 5, the central region 150 of the heat-control plate 105 is curved in an arc, whereas the edge regions 151 and 152 are in the form of a flat plate.

Cuts 153 extending in the circumferential direction of the belt are made in the edge region 151 at a plurality of positions in the direction of width of the belt with a predetermined interval between adjacent cuts. The cuts 153 divide the edge region 151 into first sections 155 and second sections 156 that alternate in the direction of width of the belt.

Cuts are similarly formed in the other edge region 152, dividing the edge region 152 into first sections 158 and second sections 159 that alternate in the direction of width of the belt.

The central region 160 of the support member 106 is curved in an arc, whereas the edge regions 161 and 162 are in the form of a flat plate.

The central region 160 is connected to one edge region 161 by a step 163, and the central region and 160 is connected to the other edge region 162 by a step 164.

Slits 165 elongated in the direction of width of the belt are bored into the step 163, and slits 166 elongated in the direction of width of the belt are similarly bored into the step 164. While a plurality of slits 165 and 166 are provided at intervals in the direction of width of the belt, only one of each is shown in FIG. 5.

In the above structure, with the first sections 155 of the heat-control plate 105 overlapping the upper surface of the edge region 161 of the support member 106, and the second sections 156 of the heat-control plate 105 fit into the slits 165 of the support member 106, the edge region 151 of the heat-control plate 105 is supported by the edge region 161 of the support member 106 by, for example, being bonded thereto.

Similarly, with the first sections 158 of the heat-control plate 105 overlapping the lower surface of the edge region 162 of the support member 106, and the second sections 159 of the heat-control plate 105 fitted into the slits 166 of the support member 106, the edge region 152 of the heat-control plate 105 is supported by the edge region 162 of the support member 106 by, for example, being bonded thereto.

Figure 6:
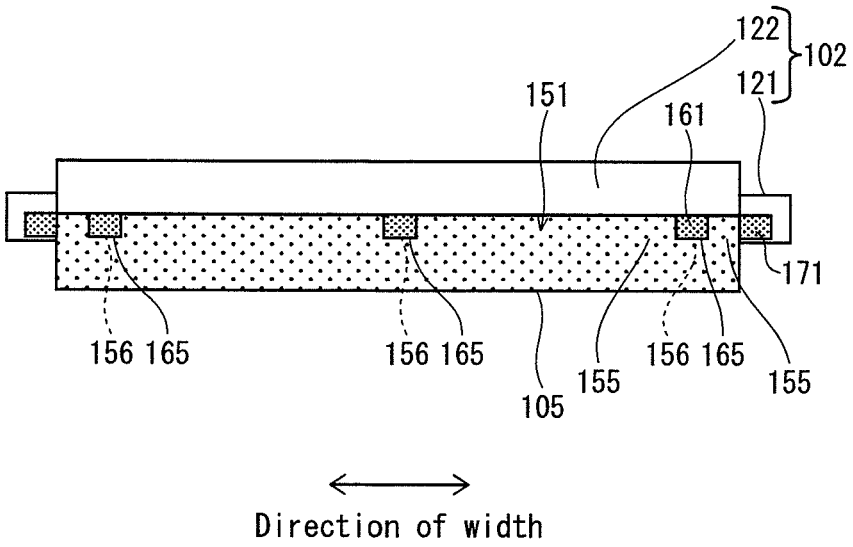
FIG. 6 is a plan view of the heat-control plate being supported by the support member as viewed from the direction indicated by the arrow H in FIG. 5.

FIG. 6 is a plan view of the edge region 151 of the heat-control plate 105 being supported by the edge region 161 of the support member 106 when viewed from the direction indicated by the arrow H in FIG. 5. FIG. 6 also illustrates the positional relationship of the fixing roller 102. In order to clearly illustrate how the edge region 151 of the heat-control plate 105 overlaps the edge region 161 of the support member 106, the heat-control plate 105 and the support member 106 are depicted with different patterns.

As shown in FIG. 6, the first sections 155 within the edge region 151 of the heat-control plate 105 overlap the upper surface of the edge region 161 of the support member 106. At the overlapping portions, the edge region 161 of the support member 106 is hidden from view by the edge region 151 of the heat-control plate 105. The upper surface of the edge region 161 of the support member 106 can only be seen where the second sections 156 of the heat-control plate 105 are fitted into the slits 165 in the support member 106.

FIG. 6 shows an example in which three second sections 156 are provided in the edge region 151 of the heat-control plate 105, and three slits 165 corresponding to the three second sections 156 are provided in the support member 106. While FIG. 6 shows one edge region 151 of the heat-control plate 105 being supported by the edge region 161 of the support member 106, the structure for the other edge region 152 of the heat-control plate 105 to be supported by the edge region 162 of the support member 106 is similar.

Returning to FIG. 5, L-shaped mounts 171 and 172 are provided at one end in the direction of width of the belt of the edge regions 161 and 162 of the support member 106. These mounts 171 and 172 are fixed to the device housing 191 (FIG. 7).

Figure 7:
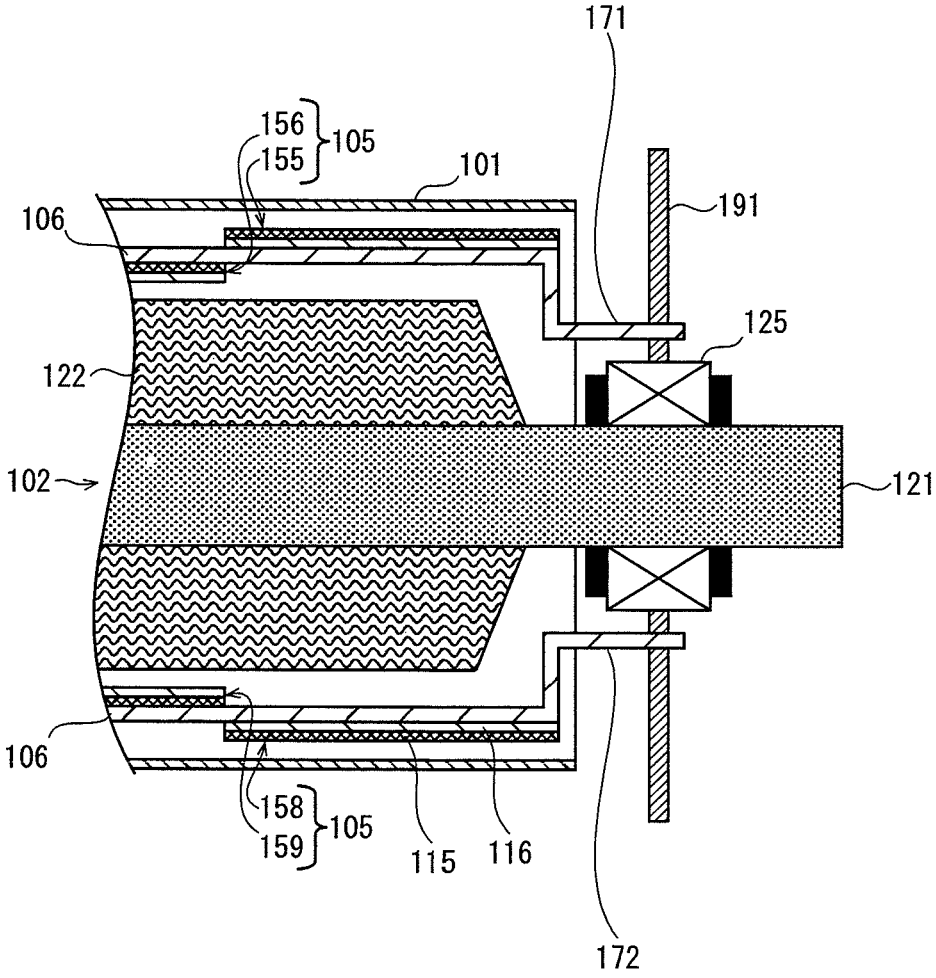
FIG. 7 is a cross-section diagram of the fixing unit along a line from F to Fin FIG. 3.

FIG. 7 is a cross-section diagram of the fixing unit 40 along a line from F to F in FIG. 3, showing one edge in the direction of width of the belt.

As shown in FIG. 7, the tips of the mounts 171 and 172 of the support member 106 are fixed by, for example, being bonded or screwed to the device housing 191. The other end in the direction of width of the belt has the same structure.

This fixed support guarantees sufficient strength between the support member 106 and the device housing 191 so that the support member 106 will not deform due to friction that occurs between the fixing belt 101 and the heat-control plate 105 and that acts on the support member 106 via the heat-control plate 105.

3. Working Example and Comparative Examples

FIG. 8 shows the results of an experiment on temperature rise characteristics of the fixing belt 101 when adopting the structure of the heat-control plate 105 in a working example and the structure of the heat-control plate in two comparative examples. FIG. 8 shows the result of measuring the time it takes for the temperature at the central region of the fixing belt 101 in the direction of width of the belt to rise to 160° C. when the fixing belt 101 is rotated and the excitation coil 141 is supplied with 1400 W power.

In the working example, the magnetic shunt alloy layer 115 in the heat-control plate 105 is 0.4 mm thick, the low-resistance conductive layer 116 is 0.3 mm thick, and the support member 106 is 1.0 mm thick.

Comparative example 1 does not include the support member 106; instead, the low-resistance conductive layer also functions as a support member. In comparative example 1, the magnetic shunt alloy layer is 0.4 mm thick, and the low-resistance conductive layer is 0.8 mm thick, which is sufficient thickness to guarantee the strength of the heat-control plate. Both ends of the heat-control plate in the direction of width of the belt are fixed directly to the device housing 191.

When both ends of the heat-control plate in the direction of width of the belt are fixed directly to the device housing 191 in this way (i.e. with a conventional structure), a moment that is the product of (i) the tension in the circumferential direction of the belt due to the friction between the rotating fixing belt and the heat-control plate and (ii) the length in the direction of width of the belt acts only on the ends of the heat-control plate in the direction of width of the belt.

When the action of the moment on the heat-control plate grows large, a force that twists the heat-control plate in the circumferential direction of the belt increases. Therefore, in order to prevent the heat-control plate from deforming, the thickness of the heat-control plate is increased. In comparative example 1, the heat-control plate is provided with increased strength by setting the thickness to 1.2 mm.

In comparative example 2, the heat-control plate 105 and the support member 106 of the working example are formed integrally (i.e. the gap 90 does not exist between the heat-control plate 105 and the support member 106). The magnetic shunt alloy layer, the low-resistance conductive layer, and the support member all have the same thickness as in the working example.

FIG. 8 clearly shows how the time for the temperature to rise is shorter for the working example than for comparative examples 1 and 2.

In comparative example 1, the heat capacity increases in correspondence with an increase, as compared to the working example, in the thickness of the low-resistance conductive layer in the heat-control plate. It can be inferred that the time for the temperature to rise increased in response to the increase in the heat capacity.

In comparative example 2, the magnetic shunt alloy layer, the low-resistance conductive layer, and the support member all have the same thickness as in the working example, but the heat-control plate and the support member are formed integrally, and no gap 90 exists between the central region 150 of the heat-control plate 105 (the portion facing the magnetic flux generator 104) and the central region 160 of the support member 106.

When viewing the portion of the fixing belt 101 facing the magnetic flux generator 104 (the main region of heat generation), heat from the main region of heat generation of the fixing belt 101 transfers to the central region 150 of the heat-control plate 105 but does not easily transfer to the central region 160 of the support member 106 due to the gap 90 in the working example. On the other hand, in comparative example 2, the heat-control plate and the support member are integral, thus facilitating transfer of heat from the main region of heat generation of the fixing belt 101 to the support member via the heat-control plate.

In other words, whereas comparative example 2 includes a support member to which heat from the fixing belt 101 in the main region of heat generation of the fixing belt 101 is transferred, no such support member substantially exists in the working example. It can therefore be inferred that the heat capacity is greater in comparative example 2 than in the working example, thus causing the time for the temperature to rise to be longer in comparative example 2 than in the working example.

In the working example, the support member 106 that supports the heat-control plate 105 is not in contact with the heat-control plate 105 at the central region 150, but rather supports the edge regions 151 and 152 of the heat-control plate 105. Furthermore, the ends of the support member 106 in the direction of width of the belt are fixed to the device housing 191.

Accordingly, in the main region of heat generation of the fixing belt 101, the gap 90 between the heat-control plate 105 and the support member 106 makes it difficult for heat from the fixing belt 101 to transfer to the support member 106. Substantially, then, the heat-control plate 105 becomes the only member that contributes to determining the heat capacity. As compared to comparative examples 1 and 2, the working example therefore has a reduced heat capacity and improved temperature rise characteristics.

Since the edge regions 151 and 152 of the heat-control plate 105 in the circumferential direction of the belt are supported by the support member 106, the edge regions 151 and 152 are acted on by the tension in the circumferential direction of the belt due to the friction between the rotating fixing belt 101 and the heat-control plate 105. This tension, however, is smaller than the above-described moment. It is therefore unnecessary to increase the strength of the heat-control plate 105 by increasing the thickness thereof, resulting in a thinner structure than comparative example 1. Furthermore, since the fixing belt 101 is elongated in the direction of width of the belt, the region of the heat-control plate 105 in the direction of width of the belt that is supported by the support member 106 can be expanded as compared to the structure of comparative example 1, in which the ends in the direction of width of the belt are supported by the device housing 191.

This allows for a decrease in the thickness of the heat-control plate 105 within a range that both prevents deformation of the heat-control plate 105 and permits the self-adjusting temperature control function to operate. The overall result is a decrease in heat capacity while preventing deformation of the heat-control plate 105.

Modifications

The present invention has been described based on the embodiment, but the present invention is of course in no way limited to the above embodiment. The following modifications are possible.

(1) In the above embodiment, the heat-control plate 105 is supported by the support member 106 by being bonded thereto, but any method of fastening the heat-control plate 105 and the support member 106 together may be used. For example, these two components may be fastened with eyelets.

Figure 9:
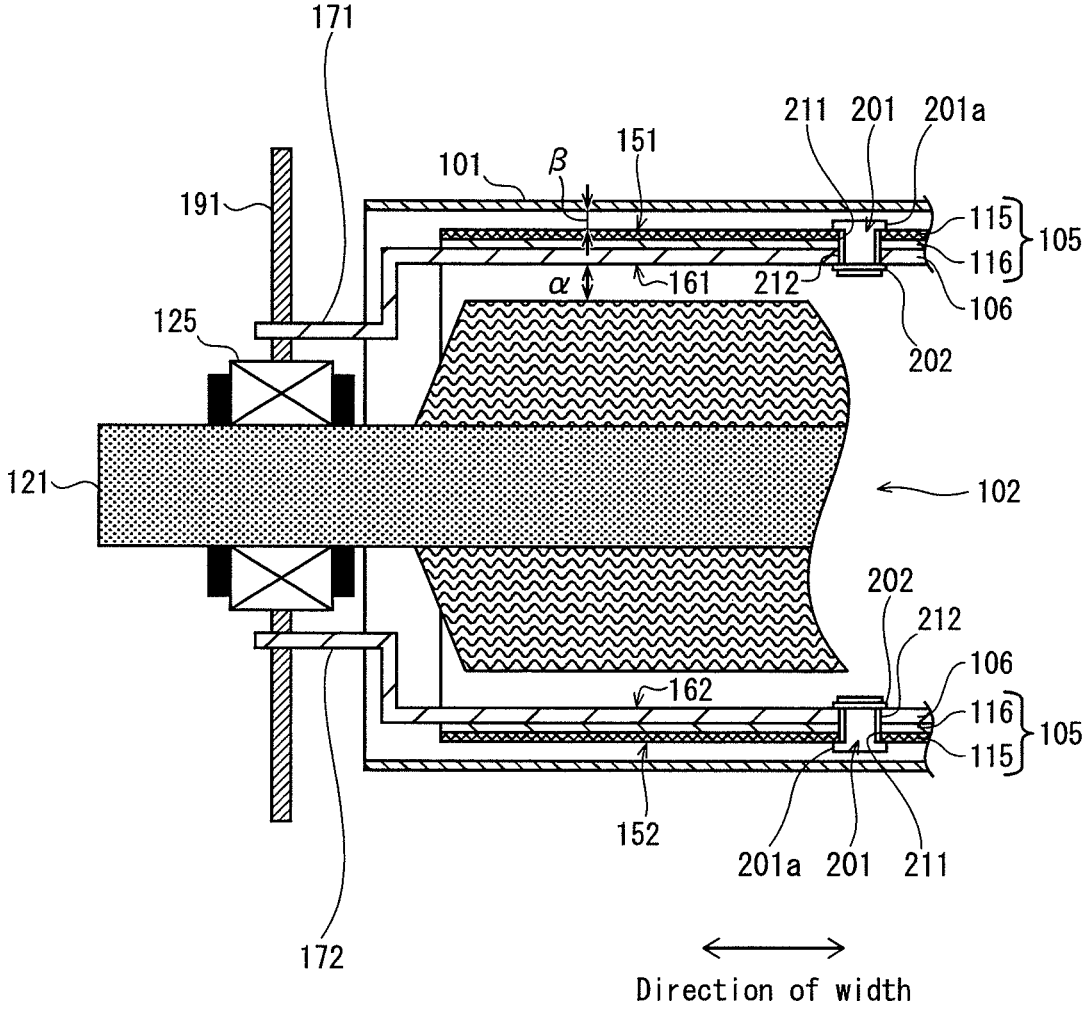
FIG. 9 is a cross-section diagram of one end of the fixing roller in a modification in which the heat-control plate and the support member are fastened with eyelets.
Figure 10:
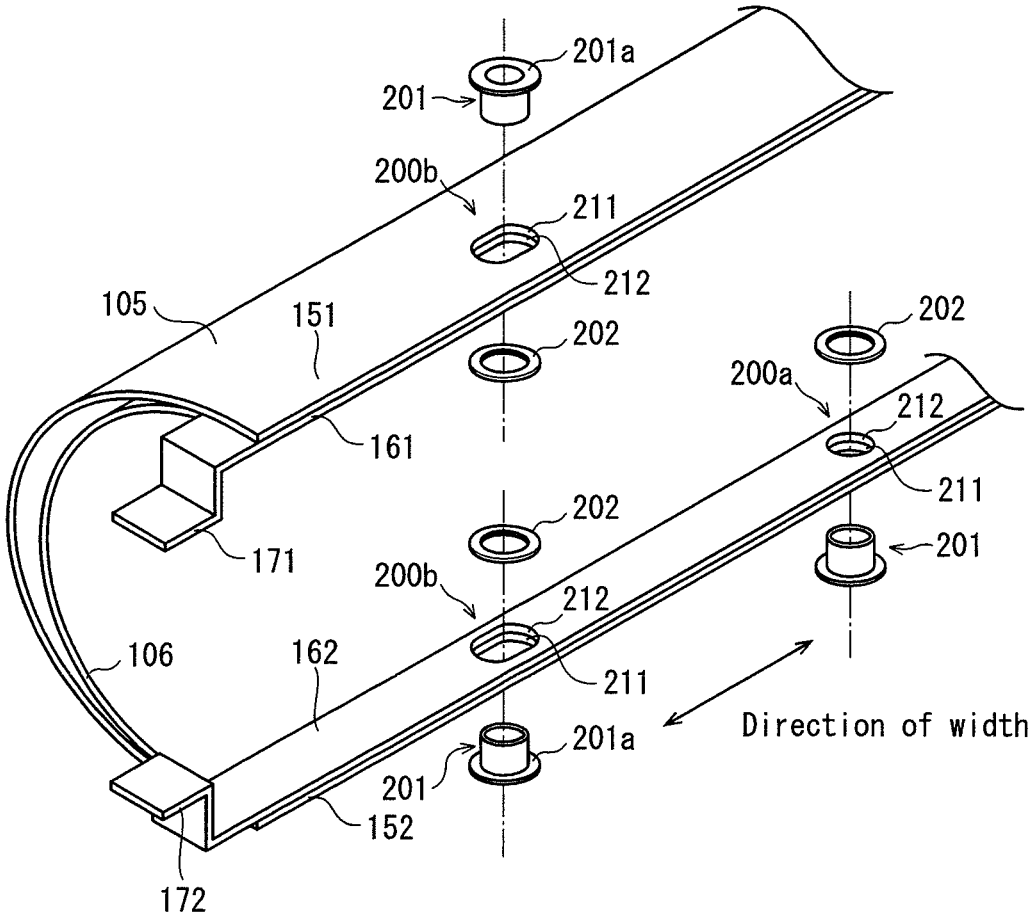
FIG. 10 is an exploded perspective view of the modification that adopts eyelets.

FIG. 9 is a cross-section diagram of one end of a fixing roller 102 in a structure adopting fastening with eyelets, and FIG. 10 is an exploded perspective view showing only the heat-control plate 105 and the support member 106. As illustrated in FIGS. 9 and 10, the heat-control plate 105 and the support member 106 are provided with through-holes 211 and 212 through which eyelets 201 pass.

With the edge region 151 of the heat-control plate 105 and the edge region 161 of the support member 106 in overlap, the tip of each eyelet 201 is passed through the corresponding through-hole 211 of the heat-control plate 105 and the corresponding through-hole 212 of the support member 106 in this order. After a washer 202 is attached at the back side of the support member 106, the tip of each eyelet 201 is then crimped in order to fasten the edge region 151 of the heat-control plate 105 and the edge region 161 of the support member 106 together.

Similarly, with the edge region 152 of the heat-control plate 105 and the edge region 162 of the support member 106 in overlap, the tip of each eyelet 201 is passed through the corresponding through-hole 211 of the heat-control plate 105 and the corresponding through-hole 212 of the support member 106 in this order. After a washer 202 is attached at the back side of the support member 106, the tip of each eyelet 201 is then crimped in order to fasten the edge region 152 of the heat-control plate 105 and the edge region 162 of the support member 106 together.

The edge region 151 of the heat-control plate 105 and the edge region 161 of the support member 106 are fastened together with a gap of a predetermined size, for example approximately 0.1 mm, provided in the direction of thickness of the fastened portion (the edge regions 151 and 161). Such a gap is also provided between the edge region 152 of the heat-control plate 105 and the edge region 162 of the support member 106.

Three fastening locations for the eyelets 201 are provided in the edge region 151 of the heat-control plate 105 and in the edge region 161 of the support member 106 at intervals in the direction of width of the belt. Similarly, three fastening locations are provided in the edge region 152 of the heat-control plate 105 and in the edge region 162 of the support member 106 at intervals in the direction of width of the belt.

Among these three fastening locations, the central fastening location is located at the center of the heat-control plate 105 in the direction of width of the belt, whereas the other two outer fastening locations are located equidistant from the central fastening location in the direction of width of the belt.

In FIG. 10, the central fastening location is labeled 200*a*, and the outer fastening locations are labeled 200*b*. The through-holes 211 and 212 for the central fastening location 200*a* are round, whereas the through-holes 211 and 212 for the outer fastening locations 200*b* are in the shape of an oval elongated in the direction of width of the belt.

Forming the through-holes for the outer fastening locations as ovals provides the through-holes with play in the direction of width of the belt. Furthermore, providing a gap (of 0.1 mm in the above example) between the heat-control plate 105 and the support member 106 provides play in the direction of thickness of the heat-control plate 105. As compared to other methods of fastening, such as welding or using screws, providing play in the above locations compensates for distortion or deformation of components arising due to the difference in the coefficients of thermal expansion of the heat-control plate 105 (i.e. the magnetic shunt alloy layer 115 and the low-resistance conductive layer 116) and the support member 106. Providing play in the above locations therefore reduces deformation of the heat-control plate 105 and the support member 106.

A large amount of deformation of the heat-control plate 105 and the support member 106 accelerates wear of the fixing belt 101 due to the inner surface of the fixing belt 101 coming into contact during rotation with the edge regions 151 and 152 of the heat-control plate 105. Such deformation also accelerates wear of the fixing roller 102 due to the surface of the fixing roller 102 coming into contact during rotation with the edge regions 161 and 162 of the support member 106. The structure of the present modification, however, prevents wear of the fixing belt 101 and the fixing roller 102 and increases the durability of the fixing belt 101 and the fixing roller 102.

Note that when fastening with eyelets, a head 201*a* of each eyelet 201 protrudes from the surface of the heat-control plate 105, whereas the washers 202 protrude from the back surface of the support member 106.

In the present modification, the washers 202 protrude to a greater degree than the head 201*a* of the eyelets 201. The greater amount of protrusion thus faces the fixing roller 102, so that the side of the heat-control plate 105 that has the smaller amount of protrusion from the head 201*a* faces the fixing belt 101.

As illustrated in FIG. 9, let the gap between the fixing roller 102 and the edge regions 161 and 162 of the support member 106 be $\alpha$, and let the gap between the fixing belt 101 and the edge regions 151 and 152 of the heat-control plate 105 be $\beta$. If the relationship $\alpha>\beta$ holds, and the gap $\beta$ is narrow, then it becomes easy for the fixing belt 101 to come into contact with the edge regions 151 and 152 of the heat-control plate 105 due to variations in the position of the fixing belt 101 resulting from vibration during rotation. Therefore, if the relationship $\alpha>\beta$ holds, contact between the rotating fixing belt 101 and the edge regions 151 and 152 of the heat-control plate 105 can be avoided by fastening the heat-control plate 105 and the support member 106 with eyelets so that the side of the heat-control plate 105 having the smaller amount of protrusion from the head 201*a* faces the fixing belt 101.

Note that the number and positions of the fastening locations for the eyelets, as well as the value of the gap between the heat-control plate 105 and the support member 106, are not limited to the above values. Appropriate values are determined in accordance with the device structure.

Furthermore, while the through-holes 211 and 212 have been described as being either round or oval, depending on the fastening location, the through-holes 211 and 212 are not limited to these shapes. For example, if the effects of the difference in the coefficients of thermal expansion can be suppressed by providing the above gaps, all of the through-holes may be formed to be round. Moreover, as long as the effects of the difference in the coefficients of thermal expansion can be compensated for without providing a gap of a predetermined size, the gap may be omitted, with the heat-control plate 105 and the support member 106 being provided in close contact.

While a method of providing two components, i.e. an eyelet 201 and a washer 202, has been described, one tubular eyelet may instead be adopted, for example with both ends of the eyelet being crimped.

Figure 11:
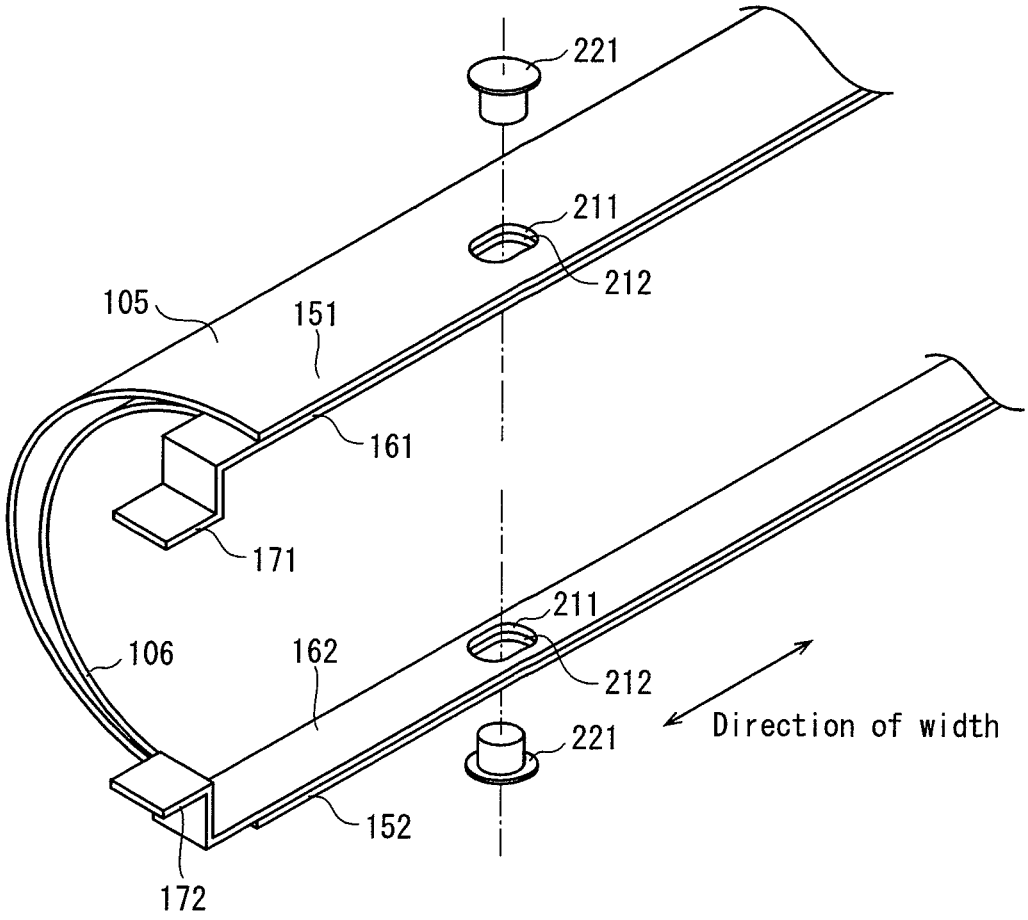
FIG. 11 is an exploded perspective view of a modification in which the heat-control plate and the support member are fastened with rivets.

Additionally, the fastening member that fastens the heat-control plate 105 to the support member 106 is not limited to the eyelets 201. For example, instead of the eyelets 201, rivets 221 as illustrated in FIG. 11 may be used as the fastening member.

Fastening with rivets, as when fastening with eyelets, compensates for distortion arising due to the difference in the coefficients of thermal expansion of the heat-control plate 105 and the support member 106, thereby achieving the advantageous effect of suppressing deformation of the heat-control plate 105 and the support member 106.

(2) In the above embodiment, a cross-section of the central region 160 of the support member 106 is curved, but as long as the support member 106 does not come into contact with the central region 150 of the heat-control plate 105, the central region 160 need not be curved. The central region 160 may, for example, have one or more corners.

Furthermore, while the example of the support member 106 described above has a central region 160 and edge regions 161 and 162, the support member 106 is not limited in this way. For example, a structure without the central region 160 may be adopted.

If the central region 160 and the edge regions 161 and 162 are integrated as in the embodiment, the edge regions 161 and 162 are in contact with each other via the central region 160. This both increases the strength of the support member 106 and facilitates assembly at the time of manufacturing of the fixing unit 40, since it suffices to support the heat-control plate 105 with the support member 106 and insert the integral combination of these two components into the fixing belt 101. On the other hand, providing only the edge regions 161 and 162 without providing the central region 160 saves on materials by eliminating the need for the central region 160, thereby lowering costs.

(3) In the above embodiment, the method by which the support member 106 supports the heat-control plate 105 is to fit the second sections 156 and 159 of the edge regions 151 and 152 of the heat-control plate 105 into the slits 165 and 166 provided in the steps 163 and 164 of the support member 106, and then to bond the edge regions 151 and 152 of the heat-control plate 105 to the edge regions 161 and 162 of the support member 106. The support method, however, is certainly not limited to this example. If support can be maintained simply by fitting the second sections 156 and 159 into the slits 165 and 166, bonding is unnecessary. Furthermore, whether or not steps are provided, another method such as welding or mechanical fixing may be used.

In addition, while the mounts 171 and 172 of the support member 106 are fixed to the device housing 191 in the above example, the mounts 171 and 172 need not be fixed when adopting a structure such that the heat-control plate 105 is in contact with the inner circumferential surface of the fixing belt 101 during rotation of the fixing belt 101. For example, the following structure may be adopted. In order for the heat-control plate 105 to be moveable so as to come into contact with or separate from the inner circumferential surface of the fixing belt 101, the support member 106 may be movably supported by the device housing 191, and during rotation of the fixing belt 101, the driving force from the actuator of a motor or the like may displace the support member 106 to a position at which the heat-control plate 105 comes into contact with the inner circumferential surface of the fixing belt 101.

(4) In the above embodiment, an example is described in which the fixing roller 102 is disposed along the inside of the running path of the fixing belt 101. The pressed member is not limited to being a roller, however, as long as the pressed member is pressed by a pressing member, such as the pressing roller 103, from the outside of the running path of the fixing belt 101 so that the fixing belt 101 is sandwiched therebetween, thus guaranteeing formation of the fixing nip N.

For example, instead of a roller, a fixing pad may be used. If a fixing pad is used, then instead of the mounts 171 and 172 of the support member 106 being supported by the device housing 191 outside of the fixing belt 101, the mounts 171 and 172 may be supported by the fixing pad on the inside of the running path of the fixing belt 101.

Furthermore, a structure has been described wherein the pressing roller 103 is provided as the pressing member, but the pressing member is not limited in this way. Alternatively, a pressing pad or the like may be used.

(5) In the above embodiment, an example is described in which the region (first region) of the heat-control plate 105 facing the magnetic flux generator 104, with the fixing belt 101 therebetween, is the central region 150 in the circumferential direction of the belt, from one end of the coil bobbin 140 to the other end in the circumferential direction of the belt, but the first region is not limited in this way. A portion that includes the excitation coil 141 along the coil bobbin 140 (the entire region over which the conducting wire is wound around the coil bobbin 140) and the cores may be considered to be the magnetic flux generator, and the region facing this portion may be considered the first region. Alternatively, the excitation coil 141 alone may be considered the magnetic flux generator, and the region facing the excitation coil 141 may be considered the first region.

(6) In the above embodiment, an example of adopting the fixing device and the image forming apparatus according to the present invention in a tandem-type color printer is described, but the present invention is not limited in this way. The present invention may be adopted in, for example, a photocopier, a facsimile device, a Multiple Function Peripheral (MFP), or the like, regardless of whether image formation is color or monochrome, as long as the present invention is embodied as a fixing device based on electromagnetic induction heating, or an image forming apparatus provided with the fixing device, that includes a magnetic flux generator on the outside of the running path of an endless belt that includes an induction heating layer, the magnetic flux generator generating magnetic flux for heating the induction heating layer of the belt, and that includes a heat-control plate on the inside of the running path of the belt, the heat-control plate having a magnetic shunt alloy layer that loses its magnetism upon exceeding a predetermined temperature (Curie point) that is higher that the fixing temperature.

Note that the measurements, shape, material, etc. of the fixing belt 101, the fixing roller 102, the heat-control plate 105, the support member 106, and other components are not limited to the above examples. The measurements, shape, and the like may of course be determined in accordance with the structure of the device.

The above embodiment and modifications may be combined with one another.

SUMMARY

The above embodiment and modifications are one aspect of the present invention for solving the problems discussed in the Description of the Related Art. The above embodiment and modifications may be summarized as follows.

A fixing device according to an aspect of the present invention is based on electromagnetic induction heating that, when a sheet with an unfixed image formed thereon passes through a fixing nip, applies heat and pressure to the sheet in order to fix the unfixed image thereto, the fixing device comprising: an endless belt driven to rotate and including an induction heating layer; a pressing member pressing against a surface of the belt to form the fixing nip between the pressing member and the surface of the belt; a magnetic flux generator provided outside of a running path of the belt and generating magnetic flux to cause the induction heating layer to heat; a heat-control plate provided inside of the running path of the belt and including a magnetic shunt alloy layer that loses magnetism upon exceeding a predetermined temperature higher than a fixing temperature; and a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions.

In the above fixing device according to an aspect of the present invention, a cross-section of the first region of the heat-control plate may be an arc that curves along an inner circumferential surface of the belt, and the support member may include: a third region located farther from the magnetic flux generator than the first region of the heat-control plate and facing the first region with a gap therebetween; and fourth regions extending continuously in a circumferential direction of the belt from opposite edges of the third region, one of the fourth regions coming into contact with and supporting one of the second regions of the heat-control plate, and the other one of the fourth regions coming into contact with and supporting the other one of the second regions of the heat-control plate.

In the above fixing device according to an aspect of the present invention, a cross-section of the third region of the support member may be an arc that curves along the first region of the heat-control plate.

The above fixing device according to an aspect of the present invention may further comprise: a housing; and a roller provided inside the running path of the belt and pressed against by the pressing member with the belt therebetween, wherein the support member is longer, in a direction of width of the belt, than the belt is, and an edge of the support member in a direction of length thereof is fixed to the housing at a location away from the belt in the direction of width of the belt.

In the above fixing device according to an aspect of the present invention, the first region of the heat-control plate may be in contact with an inner circumferential surface of the belt while the belt is driven to rotate.

In the above fixing device according to an aspect of the present invention, the support member may have a slit provided therein, and a portion of one of the second regions of the heat-control plate may be fitted into the slit.

In the above fixing device according to an aspect of the present invention, the heat-control plate and the support member may be fastened together by a fastening member at a plurality of locations in the second regions where the heat-control plate and the support member are in contact.

In the above fixing device according to an aspect of the present invention, the fastening member may be a rivet.

In the above fixing device according to an aspect of the present invention, the fastening member may be an eyelet.

An image forming apparatus according to an aspect of the present invention comprises: an unfixed image forming unit forming an unfixed image on a sheet; and a fixing device fixing the unfixed image to the sheet by applying heat and pressure to the sheet when the sheet passes through a fixing nip, the fixing device comprising: an endless belt driven to rotate and including an induction heating layer; a pressing member pressing against a surface of the belt to form the fixing nip between the pressing member and the surface of the belt; a magnetic flux generator provided outside of a running path of the belt and generating magnetic flux to cause the induction heating layer to heat; a heat-control plate provided inside of the running path of the belt and including a magnetic shunt alloy layer that loses magnetism upon exceeding a predetermined temperature higher than a fixing temperature; and a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions.

In the above image forming apparatus according to an aspect of the present invention, a cross-section of the first region of the heat-control plate may be an arc that curves along an inner circumferential surface of the belt, and the support member may include: a third region located farther from the magnetic flux generator than the first region of the heat-control plate and facing the first region with a gap therebetween; and fourth regions extending continuously in a circumferential direction of the belt from opposite edges of the third region, one of the fourth regions coming into contact with and supporting one of the second regions of the heat-control plate, and the other one of the fourth regions coming into contact with and supporting the other one of the second regions of the heat-control plate.

In the above image forming apparatus according to an aspect of the present invention, a cross-section of the third region of the support member may be an arc that curves along the first region of the heat-control plate.

In the above image forming apparatus according to an aspect of the present invention, the fixing device may further comprise: a housing; and a roller provided inside the running path of the belt and pressed against by the pressing member with the belt therebetween, wherein the support member is longer, in a direction of width of the belt, than the belt is, and an edge of the support member in a direction of length thereof is fixed to the housing at a location away from the belt in the direction of width of the belt.

In the above image forming apparatus according to an aspect of the present invention, the first region of the heat-control plate may be in contact with an inner circumferential surface of the belt while the belt is driven to rotate.

In the above image forming apparatus according to an aspect of the present invention, the support member may have a slit provided therein, and a portion of one of the second regions of the heat-control plate may be fitted into the slit.

In the above image forming apparatus according to an aspect of the present invention, the heat-control plate and the support member may be fastened together by a fastening member at a plurality of locations in the second regions where the heat-control plate and the support member are in contact.

In the above image forming apparatus according to an aspect of the present invention, the fastening member may be a rivet.

In the above image forming apparatus according to an aspect of the present invention, the fastening member may be an eyelet.

With the above structure, tension in the circumferential direction of the belt due to the friction between the belt and the heat-control plate acts on the portion of the heat-control plate supported by the support member. This tension, however, is less than the moment that acts on both ends of the heat-control plate in the direction of width of the belt in a conventional structure in which these ends are directly fixed to the device housing, such moment being the product of the tension in the circumferential direction of the belt and the length in the direction of width of the belt. As a result, it is not necessary in the above structure to increase the thickness of the heat-control plate in order to prevent deformation due to the action of the moment. The above structure is therefore thinner than a conventional structure.

Reducing the thickness of the heat-control plate allows for a reduction in the heat capacity of the heat-control plate, thereby reducing the transfer of heat from the belt. In a conventional structure, a thick heat-control plate results in a large heat capacity, which causes heat from the belt to escape directly to the device housing via the heat-control plate. As compared to this conventional structure, the transfer of heat, produced by electromagnetic induction, from the belt to the support member via the heat-control plate is reduced, thereby improving the capability of the belt to rise in temperature.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device based on electromagnetic induction heating that, when a sheet with an unfixed image formed thereon passes through a fixing nip, applies heat and pressure to the sheet in order to fix the unfixed image thereto, the fixing device comprising:

an endless belt driven to rotate and including an induction heating layer;

a pressing member pressing against a surface of the belt to form the fixing nip between the pressing member and the surface of the belt;

a magnetic flux generator provided outside of a running path of the belt and generating magnetic flux to cause the induction heating layer to heat;

a heat-control plate provided inside of the running path of the belt and including a material whose magnetic property changes with temperature; and a support member supporting the heat-control plate, wherein the heat-control plate includes a first region facing the magnetic flux generator with the belt therebetween and second regions extending continuously in a circumferential direction of the belt from opposite edges of the first region and which second regions do not face the magnetic flux generator, and inside the running path of the belt, the support member is in contact with the heat-control plate at the second regions and not at the first region so as to support the heat-control plate at the second regions.

2. The fixing device of claim 1, wherein a cross-section of the first region of the heat-control plate is an arc that curves along an inner circumferential surface of the belt, and the support member includes: a third region located farther from the magnetic flux generator than the first region of the heat-control plate and facing the first region with a gap therebetween; and fourth regions extending continuously in a circumferential direction of the belt from opposite edges of the third region, one of the fourth regions coming into contact with and supporting one of the second regions of the heat-control plate, and the other one of the fourth regions coming into contact with and supporting the other one of the second regions of the heat-control plate.

3. The fixing device of claim 2, wherein a cross-section of the third region of the support member is an arc that curves along the first region of the heat-control plate.

4. The fixing device of claim 1, wherein the first region of the heat-control plate is in contact with an inner circumferential surface of the belt while the belt is driven to rotate.

5. The fixing device of claim 1, wherein the heat-control plate and the support member are fastened together by a fastening member at a plurality of locations in the second regions where the heat-control plate and the support member are in contact.

6. The fixing device of claim 5, wherein the fastening member is a rivet.

7. The fixing device of claim 5, wherein the fastening member is an eyelet.

8. The fixing device of claim 1, wherein the heat-control plate is configured such that the second regions of the heat-control plate are not in direct contact with the endless belt.

9. A fixing device based on electromagnetic induction heating that, when a sheet with an unfixed image formed thereon passes through a fixing nip, applies heat and pressure to the sheet in order to fix the unfixed image thereto, the fixing device comprising:

an endless belt driven to rotate and including an induction heating layer;

a pressing member pressing against a surface of the belt to form the fixing nip between the pressing member and the surface of the belt;

a magnetic flux generator provided outside of a running path of the belt and generating magnetic flux to cause the induction heating layer to heat;

a heat-control plate provided inside of the running path of the belt and including a material whose magnetic property changes with temperature;

a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions;

a housing; and a roller provided inside the running path of the belt and pressed against by the pressing member with the belt therebetween, wherein the support member is longer, in a direction of width of the belt, than the belt is, and an edge of the support member in a direction of length thereof is fixed to the housing at a location away from the belt in the direction of width of the belt.

10. A fixing device based on electromagnetic induction heating that, when a sheet with an unfixed image formed thereon passes through a fixing nip, applies heat and pressure to the sheet in order to fix the unfixed image thereto, the fixing device comprising:

an endless belt driven to rotate and including an induction heating layer;

a pressing member pressing against a surface of the belt to form the fixing nip between the pressing member and the surface of the belt;

a magnetic flux generator provided outside of a running path of the belt and generating magnetic flux to cause the induction heating layer to heat;

a heat-control plate provided inside of the running path of the belt and including a material whose magnetic property changes with temperature;

a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions;

wherein the support member has a slit provided therein, and a portion of one of the second regions of the heat-control plate is fitted into the slit.

11. An image forming apparatus in which the fixing device according to claim 10 is provided, the image forming apparatus comprising:

an unfixed image forming unit forming an unfixed image on a sheet; and a fixing device fixing the unfixed image to the sheet by applying heat and pressure to the sheet when the sheet passes through a fixing nip.

12. An image forming apparatus comprising:

an unfixed image forming unit forming an unfixed image on a sheet; and a fixing device fixing the unfixed image to the sheet by applying heat and pressure to the sheet when the sheet passes through a fixing nip, the fixing device comprising:

an endless belt driven to rotate and including an induction heating layer;

a pressing member pressing against a surface of the belt to form the fixing nip between the pressing member and the surface of the belt;

a magnetic flux generator provided outside of a running path of the belt and generating magnetic flux to cause the induction heating layer to heat;

a heat-control plate provided inside of the running path of the belt and including a material whose magnetic property changes with temperature; and a support member supporting the heat-control plate, wherein the heat-control plate includes a first region facing the magnetic flux generator with the belt therebetween and second regions extending continuously in a circumferential direction of the belt from opposite edges of the first region and which second regions do not face the magnetic flux generator, and inside the running path of the belt, the support member is in contact with the heat-control plate at the second regions and not at the first region so as to support the heat-control plate at the second regions.

13. The image forming apparatus of claim 12, wherein a cross-section of the first region of the heat-control plate is an arc that curves along an inner circumferential surface of the belt, and the support member includes: a third region located farther from the magnetic flux generator than the first region of the heat-control plate and facing the first region with a gap therebetween; and fourth regions extending continuously in a circumferential direction of the belt from opposite edges of the third region, one of the fourth regions coming into contact with and supporting one of the second regions of the heat-control plate, and the other one of the fourth regions coming into contact with and supporting the other one of the second regions of the heat-control plate.

14. The image forming apparatus of claim 13, wherein a cross-section of the third region of the support member is an arc that curves along the first region of the heat-control plate.

15. The image forming apparatus of claim 12, wherein the first region of the heat-control plate is in contact with an inner circumferential surface of the belt while the belt is driven to rotate.

16. The image forming apparatus of claim 12, wherein the support member has a slit provided therein, and a portion of one of the second regions of the heat-control plate is fitted into the slit.

17. The image forming apparatus of claim 12, wherein the heat-control plate and the support member are fastened together by a fastening member at a plurality of locations in the second regions where the heat-control plate and the support member are in contact.

18. The image forming apparatus of claim 17, wherein the fastening member is a rivet.

19. The image forming apparatus of claim 17, wherein the fastening member is an eyelet.

20. The image forming apparatus of claim 12, wherein the heat-control plate is configured such that the second regions of the heat-control plate are not in direct contact with the endless belt.

21. An image forming apparatus comprising:

an unfixed image forming unit forming an unfixed image on a sheet; and a fixing device fixing the unfixed image to the sheet by applying heat and pressure to the sheet when the sheet passes through a fixing nip, the fixing device comprising:

an endless belt driven to rotate and including an induction heating layer;

a pressing member pressing against a surface of the belt to form the fixing nip between the pressing member and the surface of the belt;

a magnetic flux generator provided outside of a running path of the belt and generating magnetic flux to cause the induction heating layer to heat;

a heat-control plate provided inside of the running path of the belt and including a material whose magnetic property changes with temperature;

a support member supporting the heat-control plate, wherein the heat-control plate includes a first region facing the magnetic flux generator with the belt therebetween and second regions extending continuously in a circumferential direction of the belt from opposite edges of the first region, and inside the running path of the belt, the support member is in contact with the heat-control plate at the second regions and not at the first region so as to support the heat-control plate at the second regions;

a housing; and a roller provided inside the running path of the belt and pressed against by the pressing member with the belt therebetween, wherein the support member is longer, in a direction of width of the belt, than the belt is, and an edge of the support member in a direction of length thereof is fixed to the housing at a location away from the belt in the direction of width of the belt.

* * * * *